United States Patent [19]

Crossfield

[11] Patent Number: 4,999,609

[45] Date of Patent: Mar. 12, 1991

[54] ANTIPILFERAGE TAGS HAVING AN ACOUSTIC RESONATOR CHAMBER

[75] Inventor: Michael D. Crossfield, Burton End, England

[73] Assignee: Scientific Generics Limited, Cambridge, United Kingdom

[21] Appl. No.: 343,610

[22] Filed: Apr. 27, 1989

[30] Foreign Application Priority Data

Apr. 29, 1988 [GB] United Kingdom ..... 8810178

[51] Int. Cl.[5] ..... G08B 13/18

[52] U.S. Cl. ..... 340/551; 340/572

[58] Field of Search ..... 340/551, 572

[56] References Cited

U.S. PATENT DOCUMENTS 4,622,543 11/1986 Anderson, III et al. ..... 340/551

*Primary Examiner*—Glen R. Swann, III

*Attorney, Agent, or Firm*—Sixbey, Friedman, Leedom & Ferguson

[57] ABSTRACT

An antipilferage tag (10) includes an acoustic resonator chamber (12) which has a membrane (1,2) formed of a layer of magnetostrictive material (2) as well as a system which may incorporate such tags. The system has a generator for generating an alternating magnetic field and a tag capable of interacting with the alternating magnetic field to generate an alarm tone, characterized in that (i) the alarm tone is generated by a tag which includes an acoustic resonator; and (ii) the generator for generating an alternating magnetic field and the tag are so arranged that an audible alarm tone is generated by the tag when it is subjected to the alternating magnetic field.

11 Claims, 1 Drawing Sheet

Fig.1.
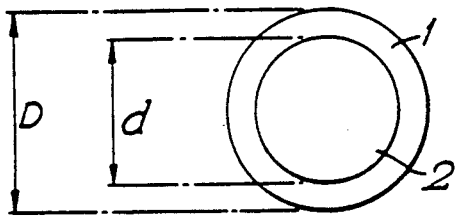
Fig.2.
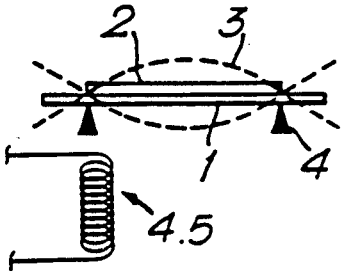
Fig.3.
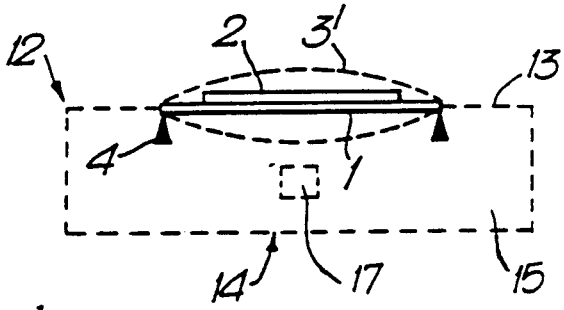
Fig.4.
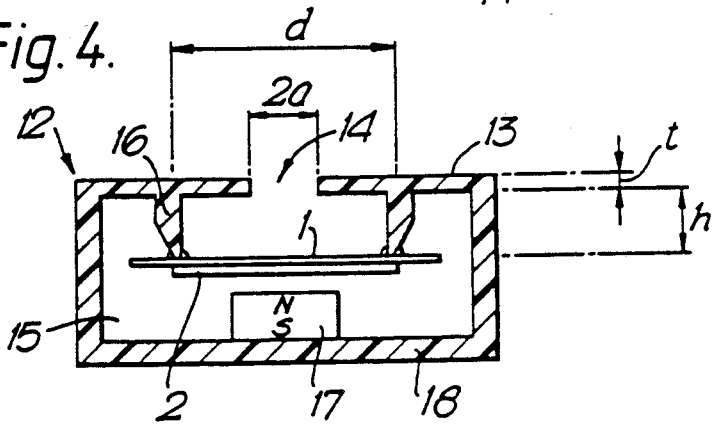
Fig.5.
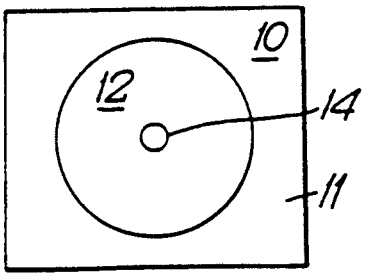
Fig.6.
$$f = \frac{v}{2\pi}\sqrt{\frac{4a^2}{d^2h(t+ka)}}$$

ANTIPILFERAGE TAGS HAVING AN ACOUSTIC RESONATOR CHAMBER

BACKGROUND OF THE INVENTION

This invention relates to antipilferage tags and to systems using such tags.

Antipilferage tags or markers are applied to articles of commerce in order to protect them from theft at the point of sale premises. Typically, the tag is a magnetic medium which is deactivated when a shop assistant carries out the routine procedure at the time of effecting a sale. Such deactivation prevents detection of the magnetic tag when it (and the article to which it is attached) passes through a detection system, typically in the form of a walk-through framework which emits an alternating matnetic interrogation field. This field is designed to interact with a tag and to respond by, for example, emitting a warning signal in the event that detection of a non-deactivated tag occurs.

Instead of arranging for the interrogation gate to emit a warning signal in the presence of a tag, an alternative system is to use the tag itself to generate an alarm signal, e.g. a high frequency tone. This can theoretically be achieved if the tag contains the circuitry required to detect the interrogating field and to respond to that field. This approach requires the incorporation of fairly sophisticated technology into what would otherwise be a relatively small and inexpensive article, the end porduct being termed a "smart tag" or an "active tag".

SUMMARY OF THE INVENTION

We have now devised a different approach which allows a simpler, "passive tag" to function actively, i.e. to generate an alarm signal in the presence of an interrogating field in the form of a high frequency alternating magnetic field.

More particualry, according to one aspect of the present invention there is provided a tag for use in an antipilferage system, which tag comprises an acoustic resonator chamber which includes a membrane formed of or including a layer of a magnetostrictive material.

In one embodiment, the membrane forms one wall, or a part of one wall of the resonator. In another embodiment, the membrane is supported within the body of the resonator cavity.

The resonator cavity will be tuned to the frequency of the interrogating magnetic field in order to achieve maximum acoustic output. For example, a cavity 30 mm in diameter and 5 mm deep with a central aperture 5 mm in diameter resonates efficiently at around 3 kHz, which is within the audible range and is close to the maximum sensitivity of the human ear. Also, the magnetic membrane is preferably biassed (either magnetically or mechanically) so that, in the absence of an external magnetic field, one face of the membrane is in tension while the opposite face is in compression. Magnetic biassing can be achieved by use of a small permanent magnet positioned adjacent the magnetic membrane.

The membrane can comprise a resilient plastice support, e.g. formed of polyethylene terephthalate, which carries over its central region, or over substantially all of its area, the layer of magnetostrictive material. Such materials are known per se and do not of themselves constitute part of the invention.

Instead of permanently biassing the membrane, the membrane can be formed as a bimorph, i.e. a lamination of two sheets, one displaying positive magnetostriction and the other displaying negative magnetostriction.

In all the forms mentioned above, the magnetic membrane is caused to flex when subjected to an external magnetic field, and such flexing generates an audible tone which is acoustically amplified by the resonator cavity, thus generating an audible alarm, provided of course that the frequency of the alternating magnetic field corresponds to a value within the range audible to the human ear. Generally, a frequency in the range 1–5 kHz will be used. A tag in accordance with this invention, therefore, can generate an audible alarm without the need, for example, for additional circuitry either within the tag itself or external thereto designed to respond to the movement of the membrane.

A tag in accordance with the present invention is preferably removed, at the point of sale, from an article to which it is attached; in this way it is not necessary to provide the tag with in-built deactivation capability. If removal of the tag from protected articles is regarded as unduly onerous, then embodiments of the tag of this invention can be deactivated without their removal from the protected articles. For example, where the membrane is magnetically biassed; the tag can be deactivated by removal of the magnetic biassing.

According to another aspect of the present invention, there is provided an antipilferage system which comprises means for generating an alternating magnetic field and a tag capable of interacting with the alternating magnetic field to generate an alarm tone, characterised in that (i) the alarm tone is generated by a tag which includes an acoustic resonator; and (ii) the means for generating in alternating magnetic field and the tag are so arranged that an audible alarm tone is generated by the tag when it is subjected to the alternating magnetic field. Preferably, a tag as defined hereinabove is employed in such a system, and the alternating magnetic field is adjusted to correspond to the resonant frequency of the tag's acoustic resonator chamber.

BRIEF DESCRIPTION OF THE SEVERAL FIGURES

For a better understanding of the invention, and to show how the same may be carried into effect, reference will now be made, by way of example, to the accompanying drawings, in which:

FIG. 1 shows, in plan view, one form of membrane for use in the invention;

FIGS. 2 and 3 illustrate methods of supporting the membrane of FIG. 1.

FIG. 4 illustrates, in sectional view, the acoustic resonator of a tag in accordance with the invention;

FIG. 5 illustrates, in plan view and on a reduced scale, a tag including the resonator of FIG. 4; and FIG. 6 is a formula for calculating the resonant frequency of a resonator such as that of FIG. 4.

DETAILED DESCRIPTION OF THE PREFERRED EMBODIMENT

Referring now to FIGS. 1–3, the membrane illustrated comprises a circular film 1 of a resilient material, e.g. a polyethylene terephthalate or a polypropylene, carrying a layer 2 of magnetostrictive material over its central region. Such a membrane can form part of one wall of an acoustic resonator as is schematically illustrated in FIG. 3 or, as illustrated in FIG. 4, it can be supported within the resonator cavity. In FIGS. 2 and 3, the means 4 for supporting the membrane are shown diagrammatically. In FIG. 2, the membrane is supported at the circumference of layer 2; in this case, a waveform 3 is generated when the magnetostrictive material is excited by alternating magnetic field generator 4.5. Because nodes occur in the body of film 1 with this arrangement, this method of support is termed nodal support. In FIG. 3, edge support of the membrane gives rise to a waveform 3' when the magnetostrictive layer is excited.

Referring next to FIGS. 4 and 5, a tag 10 in accordance with the invention comprises a moulded plastics frame 11 disposed around resonator chamber 12. The resonator is in the form of a section of a right circular cylinder, having a top face 13 in which there is a central aperture 14. The cavity 15 of the resonator includes a membrane of the type illustrated in FIGS. 1 and 2, i.e. with nodal support. Support member 16 is annular in form and depends from the interior surface of top face 13. A small permanent magnet 17 is secured to the centre of base member 18, and one pole of the magnet (the North pole in the figure) confronts magnetostrictive layer 2 of the membrane. This applies a permanent bias to the membrane, so that one face thereof is in tension and the opposite fac is in compression (the resultant curvature of the membrane is not shown in FIG. 4 for ease of illustration).

If tag 10 is subjected to an alternating external magnetic field, the magnetostrictive layer 2 and hence the whole of the membrane 1,2 is caused to flex, generating a waveform 3 such as shown in FIG. 2. By matching the external alternating field frequency to the resonant frequency of cavity 15, a resonant condition is achieved which results in the generation of an audible alarm tone. In the absence of a suitable external magnetic field, there is no tone generation.

The formula of FIG. 6 may be used to calculate the resonant frequency of a resonator such as that of FIG. 4. In the formula, f represents frequency; v is the velocity of sound; a is the radius of aperture 14; d is the diameter of magnetostrictive layer 2 when there is nodal support; h is the length of support member 16; t is the thickness of top face 13; and k is a constant related to the materials used, and is typically about 1.3. The parameters a, d, h and t are shown in FIG. 4.

I claim:

1. A tag for use in an antipilferage system, which is chartacterised in that the tag comprises an acoustic resonator chamber that is tuned to resonate an audible frequency which includes a membrane formed of or including a layer of magnetostrictive material that is arranged to resonate at said audible frequency.

2. A tag as claimed in claim 1, characterised in that said membrane forms one wall, or a part of one wall, of said acoustic resonator chamber.

3. A tag as claimed in claim 1, characterised in that said membrane is supported within the body of said resonator chamber.

4. A tag as claimed in claim 1, characterised in that said membrane comprises a resilient plastics support carrying a layer of magnetostrictive material.

5. A tag as claimed in claim 4, characterised in that said plastics support and said magnetostrictive material are substantially co-extensive.

6. A tag as claimed in claim 4, characterised in that said layer of magnetostrictive material is present over a central portion of said plastics support.

7. A tag as claimed in claim 1, characterised in that said membrane (1,2) is biassed so that, in the absence of an external magnetic field, one face of the membrane is in tension while the opposite face is in compression.

8. A tag as claimed in claim 1, characterised in that said membrane is formed as a bimorph of two sheets, one of which displayes positive magnetostriction and the other of which displays negative magnetostriction.

9. A antipliferage system which comprises means for generating an alternating magnetic field and a tag capable of interacting with the alternating magnetic field to generate an alarm tone, characterised in that the tag is a tag as claimed in claim 1, and in that the alternating magnetic field is adjusted to correspond to the resonant frequency of the acoustic resonator chamber of the tag.

10. An antipilferage system which comprises means for generating an alternating magnetic field and a tag capable of interacting with the alternating magnetic field to generate an alarm tone, characterised in that (i) the alarm is generated by a tag which includes an acoustic resonator that is tuned to resonate at an audible frequency, and a membrane formed from or including magnetostrictive material; and (ii) the means for generating an alternation magnetic field and the tag are so arranged that an audible alarm tone of said frequency is generated by the tag when it is subjected to the alternating magnetic field.

11. A tag for use in an antipilferage system, which is characterised in that the tag comprises an acoustic resonator chamber which includes a membrane formed of or including a layer of magnetostrictive material, wherein said membrane forms one wall, or a part of one wall, of said acoustic resonator.

* * * * *